US012246218B2

(12) United States Patent
Walter

(10) Patent No.: US 12,246,218 B2
(45) Date of Patent: Mar. 11, 2025

(54) GRIP EXERCISE ASSEMBLY

(71) Applicant: Lind Walter, Las Vegas, NV (US)

(72) Inventor: Lind Walter, Las Vegas, NV (US)

(73) Assignee: Lind Walter, Las Vegas, NV (US)

( * ) Notice: Subject to any disclaimer, the term of this patent is extended or adjusted under 35 U.S.C. 154(b) by 182 days.

(21) Appl. No.: 17/941,480

(22) Filed: Sep. 9, 2022

(65) Prior Publication Data

US 2023/0090164 A1 Mar. 23, 2023

Related U.S. Application Data

(60) Provisional application No. 63/247,406, filed on Sep. 23, 2021.

(51) Int. Cl.

| | |
|---|---|
| ***A63B 23/16*** | (2006.01) |
| ***A63B 21/00*** | (2006.01) |
| ***A63B 21/04*** | (2006.01) |
| ***A63B 21/055*** | (2006.01) |
| ***A63B 21/072*** | (2006.01) |

(52) U.S. Cl.

CPC ..... *A63B 23/16* (2013.01); *A63B 21/0428* (2013.01); *A63B 21/0552* (2013.01); *A63B 21/072* (2013.01); *A63B 21/4035* (2015.10)

(58) Field of Classification Search

CPC . A63B 23/16; A63B 21/0428; A63B 21/0552; A63B 21/072; A63B 21/4035; A63B 21/4045

See application file for complete search history.

(56) References Cited

U.S. PATENT DOCUMENTS

| | | | | |
|---|---|---|---|---|
| 4,951,939 | A * | 8/1990 | Peters | A63B 21/0615 482/94 |
| 5,810,697 | A * | 9/1998 | Joiner | A63B 23/047 482/68 |
| 5,820,520 | A * | 10/1998 | Sieber | A63B 23/0227 482/148 |
| 5,827,157 | A * | 10/1998 | Lee | A63B 21/06 482/93 |
| 5,997,448 | A * | 12/1999 | Duba | A63B 21/1681 482/121 |
| 6,217,483 | B1 * | 4/2001 | Kallassy | A63B 21/068 482/41 |
| 8,834,330 | B1 * | 9/2014 | Morales | A63B 21/0605 482/107 |
| 9,259,604 | B2 * | 2/2016 | Miller, Jr. | A63B 23/0405 |
| 10,555,868 | B2 * | 2/2020 | DiBenedetto | A61H 15/00 |
| 11,504,577 | B2 * | 11/2022 | Mosher | A61H 1/0229 |
| 11,517,785 | B1 * | 12/2022 | Nolan | A63B 17/04 |
| 2005/0218610 | A1 * | 10/2005 | Sankrithi | A63C 17/0046 280/14.21 |

(Continued)

*Primary Examiner* — Megan Anderson
*Assistant Examiner* — Andrew M Kobylarz
(74) *Attorney, Agent, or Firm* — DICKINSON WRIGHT PLLC

(57) ABSTRACT

A grip exercise assembly comprises a stationary body extending along an axis. The stationary body includes a stationary handle. A movable member has a tubular wall extending about the axis and that defines an interior cavity. The movable member is sleeved around the stationary body and slidable therealong. The movable member includes a movable handle and a rod configured to receive one or more plate weights and/or elastic resistors.

17 Claims, 5 Drawing Sheets

(56) References Cited

U.S. PATENT DOCUMENTS

| | | | | |
|---|---|---|---|---|
| 2014/0051556 | A1* | 2/2014 | Abassian | A63B 22/0694 482/129 |
| 2016/0089576 | A1* | 3/2016 | Rosenstiel | A63B 21/0407 482/146 |
| 2018/0104527 | A1* | 4/2018 | Meredith | A63B 71/0036 |
| 2019/0070450 | A1* | 3/2019 | Henesey | A63B 21/4033 |
| 2023/0090164 | A1* | 3/2023 | Walter | A63B 21/072 482/50 |

* cited by examiner

GRIP EXERCISE ASSEMBLY

CROSS REFERENCE TO RELATED APPLICATIONS

This U.S. utility patent application claims the benefit of U.S. Provisional Patent Application No. 63/247,406, filed Sep. 23, 2021, the contents of which is incorporated herein by reference in its entirety.

BACKGROUND OF THE INVENTION

1. Field

The present invention relates to a grip exercise assembly for providing a plurality of grip resistance settings for a user.

2. Introduction

This section provides background information related to the present disclosure which is not necessarily prior art.

Advances in technology have attributed to a sharp decrease in physical activity among the population. Modern professions oftentimes require long hours in front of a computer and tempting digital entertainment is so accessible that it has become addictive. However, as our understanding of health continues to advance, the benefits of exercise are countering some of these negative behaviors. It is now generally understood that exercise not only provides physical benefits, but that there are social and mental factors that are also enhanced. These benefits have become a common talking point the news, blogs, and social media and have, at least in part, attributed to physical health progressively becoming more popular. This ever-increasing popularity has resulted in numerous commercial opportunities, which in turn have resulted in considerable development in the art. More particularly, more and more complex exercise equipment assemblies are being sold commercially and residentially and various exercise regiments are being developed.

Generally speaking, exercise regiments include a series of activities (e.g., repetitions and sets) that focus on specific muscles or muscle groups. One particular muscle group that is particularly important are those muscles that increase grip strength as many exercises require lifting or grasping an exercise implement. Moreover, grip strength provides one of the most utilitarian benefits that an individual can develop as forearm, wrist, and hand strength is needed in day-to-day life independent of age or lifestyle. Indeed, a loss of grip strength is sometimes a first symptom of carpal tunnel syndrome. In view of the importance of grip strength, many exercise devices have been developed that focus on the forearm, wrist, and hand. However, these exercise devices are not without shortcomings. For example, these exercise devices are typically either large, complex, and expensive or are small and only provide a limited level of resistance.

As such, there is a continuing desire to develop exercise equipment that focuses on improving grip strength, that is simple to construct, and that provides a range of resistance settings.

SUMMARY OF THE DISCLOSURE

This section provides a general summary of the disclosure and should not be interpreted as a complete and comprehensive listing of all the objects, aspects, features and advantages associated with the present disclosure.

It is therefore an aspect of the present disclosure to provide a grip exercise assembly. The grip exercise assembly comprises a stationary body extending along an axis and that includes a stationary handle. A movable member has a tubular wall extending about the axis and defining an interior cavity. The movable member is sleeved around the stationary body and slidable therealong. The movable member includes a movable handle and a rod configured to receive at least one of a plate weight or an elastic resistor.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION

Example aspects will now be described more fully with reference to the accompanying drawings. In general, the subject aspects are directed to a grip exercise assembly for providing a plurality of grip resistance settings for a user. However, the example embodiments are only provided so that this disclosure will be thorough, and will fully convey the scope to those who are skilled in the art. Numerous specific details are set forth such as aspects of specific components, devices, and methods, to provide a thorough understanding of aspects of the present disclosure. It will be apparent to those skilled in the art that specific details need not be employed, that example aspects may be embodied in many different forms and that neither should be construed to limit the scope of the disclosure. In some example aspects, well-known processes, well-known device structures, and well-known technologies are not described in detail.

Referring to the Figures, wherein like numerals indicate corresponding parts throughout the several views, a grip exercise assembly is provided. The grip exercise assembly provides an improvement over the art that is simple to construct and that provides a range of resistance settings.

Figure 1:
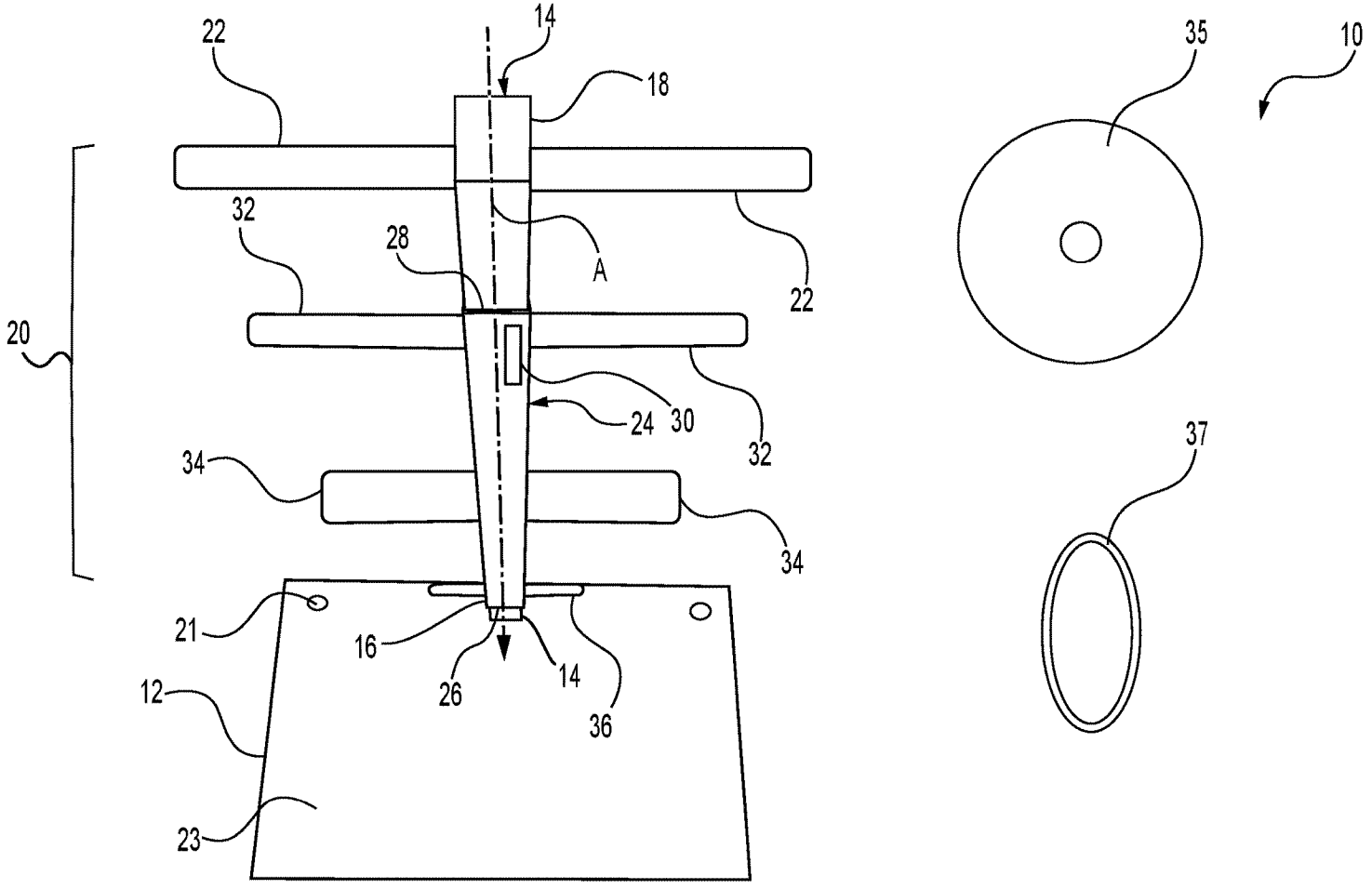
FIG. 1 shows a perspective view of an grip exercise assembly in accordance with a first embodiment.

Referring initially to FIG. 1, the grip exercise assembly 10 in accordance with a first embodiment is generally indicated. The grip exercise assembly 10 includes a floor plate 12 and a stationary body 14 mounted to a floor plate 12. The stationary body 14 extends from a base end 16 at the floor plate 12, along a center axis A, and to a distal end 18. In some embodiments, the stationary body 14 extends perpendicularly from the floor plate 12. In some embodiments, the stationary body 14 is elongated with a uniform section 20 having a uniform outer cross-section along the axis A. In some embodiments, the uniform outer cross-section is rectilinear (e.g., square) with curved corners. However, it should be appreciated that in some embodiments, the uniform outer cross-section may be other shapes, such as circular. A stationary handle 22 includes two stationary handle portions extending from opposite sides of the stationary body 14 between the uniform section 20 and the distal end 18. In some embodiments, the two stationary handle portions are each perpendicular to the axis A. In some embodiments, the floor plate 12 includes a series of apertures 21 for fasteners to secure the floor plate 12 to a substructure, such as a floor of an exercise area. In some embodiments, the floor plate 12 defines a non-smooth upper surface 23 (e.g., knurls or other topographies) to provide a stable, non-slip surface that a user may stand upon to steady the grip exercise assembly 10.

A movable member 24 includes a tubular wall defining an interior cavity (e.g., an open channel or a closed channel) that extends along the axis A such that the movable member 24 is sleeved around the uniform section 20 of the stationary body 14. The tubular wall of the movable member 24 defines an inner cross-section that is slightly larger than the uniform outer cross-section of the uniform section 20. The movable member 24 extends along the axis A between a lower end 26 oriented towards the floor plate 12 and an upper end 28 oriented towards the distal end 18 of the stationary body 14. In use, the movable member 24 is slidably connected to the stationary body 14 and movable (e.g., telescopically) along the center axis A between a rested position and a lifted position. In the rested position, the movable member 24 is located near the base end 16 of the stationary body 14 and the weight of the movable member 24 is fully supported by the stationary body 14. In the lifted position, the movable member 24 is moved along the axis A away from the base end 16 such that the weight of the movable member 24 is supported by a user. In some embodiments, the center axis A corresponds to a center of gravity of the movable member 24. In some embodiments, at least one bearing element 30 is located between the stationary body 14 and the movable member 24. The bearing element 30 may include, for example, a grease-filled cavity, a bearing ring with one or more bearing elements, such as spheres or rollers, or a combination thereof. FIG. 1 shows a box illustrating the bearing element 30. However, in some embodiments, the bearing element 30 may be disposed completely within the movable member 24 and not visible to a user.

A movable handle 32 includes two movable handle portions extending from opposite sides of the movable member 24 near the upper end 28 thereof. In some embodiments, the two stationary handle portions are each perpendicular to the axis A. The movable member 24 includes a weight-holding projection, such as a rod 34, near the lower end 26 thereof. In some embodiments, the rod 34 extends from opposite sides of the movable member 24. However, in other embodiments, the rod 34 may extend from one side of the movable member 24 that is a different side than the movable handle 32. In some embodiments, the rod 34 defines a circular cross-section with a radius of less than two inches, more than one inch, and/or sized for inserting into central holes of one or more standard plate weights with a relatively tight fit, providing little play or wobble therebetween.

A resistance holding projection 36 extends from the stationary body 14 adjacent the floor plate 12 for receiving an elastic resistor 37, which is also coupled to the moveable member 24. Thus, while in use, the grip exercise assembly 10 may provide two distinct types of resistance, a uniform resistance of lifting weights 35 and a varying resistance cause by stretching the elastic resistor 37. However, in some embodiments and/or modes of operation, only the elastic resistor 37 and related components are used and in other embodiments and/or modes of operation, only the weights 35 and related components are used. In some embodiments, and as shown in FIG. 1, the elastic resistor 37 may be a circular band. However, other configurations may be used, such as a linear elastic cord. The elastic resistor 37 may be disposed around the resistance holding projection 36 and a corresponding rod 34. However, other configurations may be used. For example, a separate holder, such as a hook, may be provided on the movable member 24 for attaching the elastic resistor 37.

Figure 3:
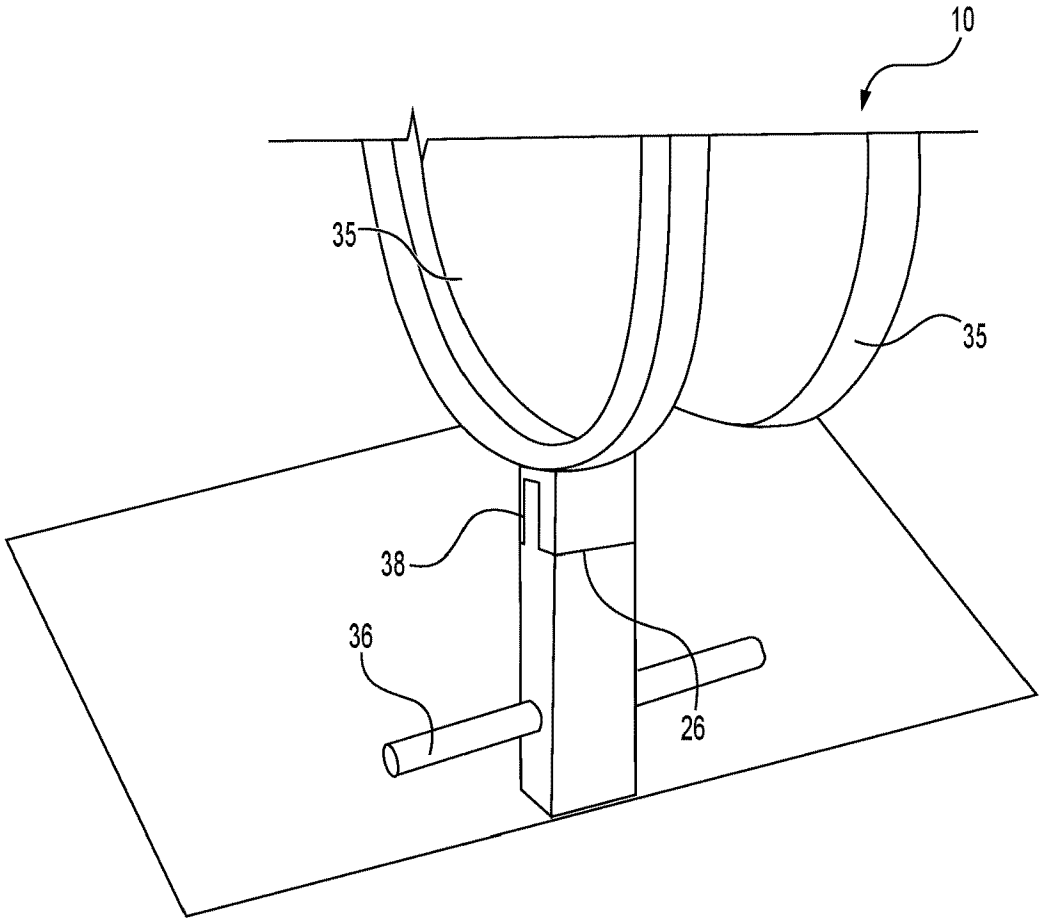
FIG. 3 shows a perspective view of a lower portion of the grip exercise assembly.
Figure 2:
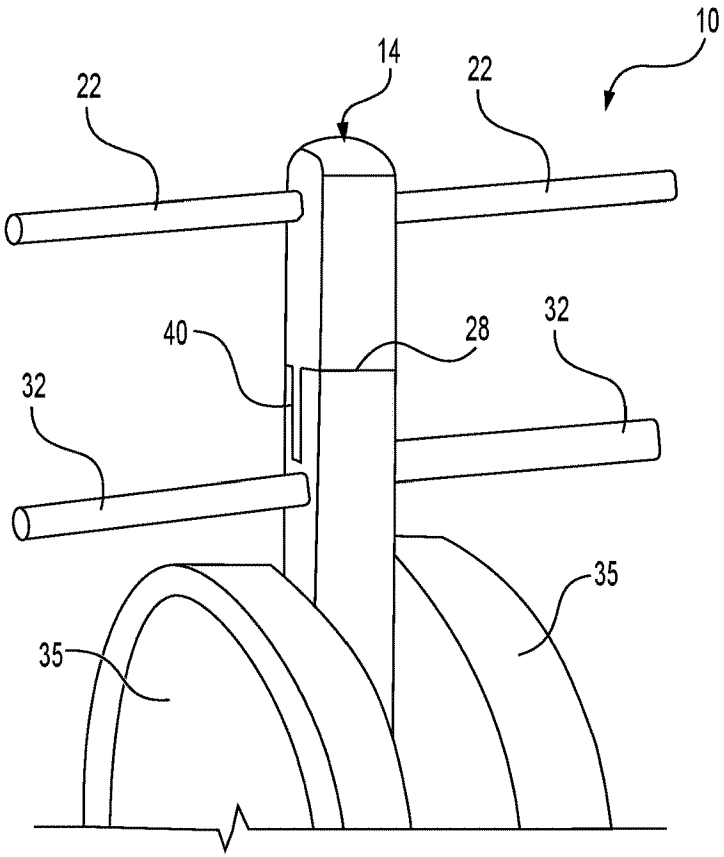
FIG. 2 shows a perspective view of an upper portion of the grip exercise assembly.

With reference now to FIGS. 2 and 3, the grip exercise assembly 10 is shown from an upper and lower perspective. In some embodiments, the movable member 24 defines first notches 38 at the lower end 26. In the rested position, the first notches 38 may extend around corresponding ones of the resistance holding projections 36, with each of the resistance holding projections 36 disposed within a corresponding one of the first notches 38. In some embodiments, the movable member 24 defines second notches 40 at the upper end 28. In the lifted position, the second notches 40 may extend around corresponding ones of the stationary handles 22, with each of the stationary handles 22 disposed within a corresponding one of the second notches 40. The first notches 38 and/or the second notches 40 allow the movable member 24 to have a greater range of motion and allows the movable handle 32 to move in close proximity to stationary handle 22. In some embodiments, the second notches 40 are sized to permit the movable handle 32 to move into contact with the stationary handle 22.

Figure 5:
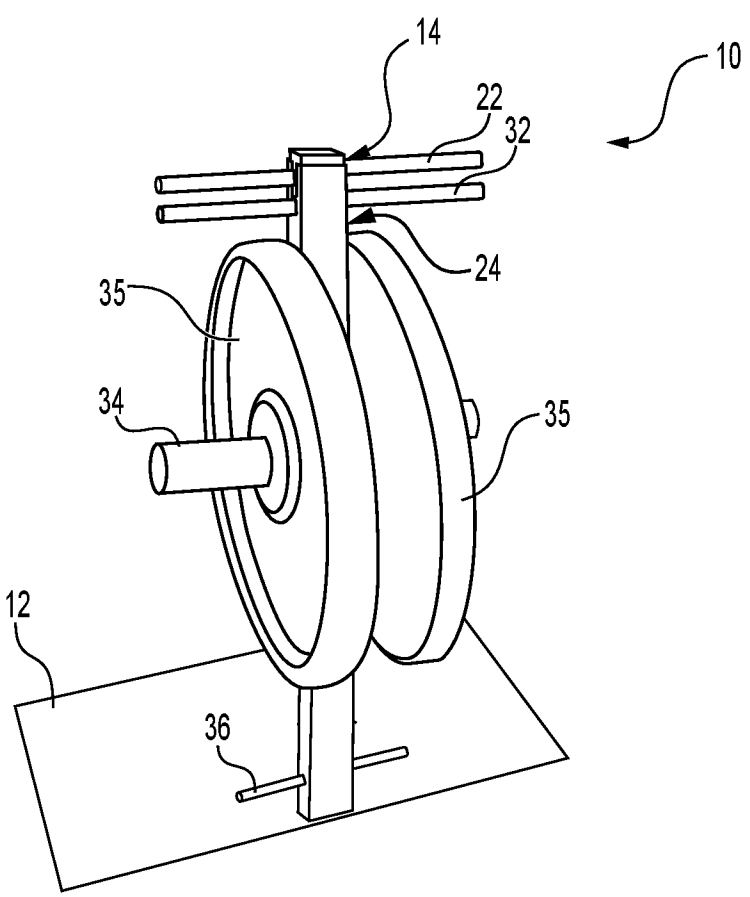
FIG. 5 shows a perspective view of the grip exercise assembly in a lifted position.
Figure 4:
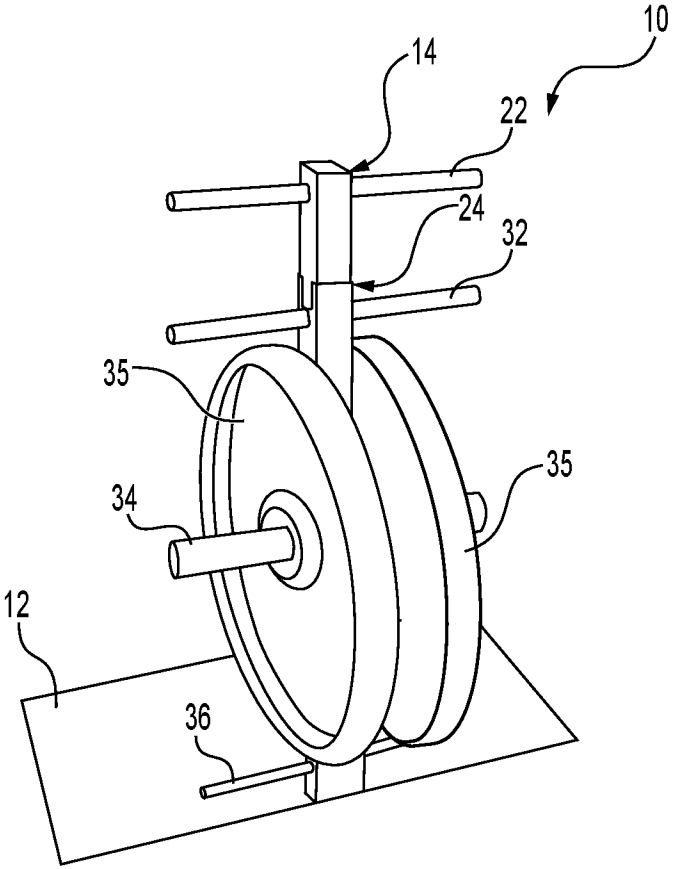
FIG. 4 shows a perspective view of the grip exercise assembly in a rested position.

The rested position is illustrated in FIG. 4 and the lifted position is illustrated in FIG. 5. In use, the user may install weights 35 on the rod 34, one or more elastic resistors 37 between the rod 34 and the resistance holding projection 36, or a combination thereof. The weights 35 may include standard weighted plates, such as those used with other weightlifting equipment. However, the weights 35 may include other types weighted material, such as solid, liquid, and/or granular forms of weighted material. The weights 35 and/or elastic resistors 37 may be placed such that each side of the rod 34 and, by extension, the handles 22, 32 have an equal amount of weight and/or elastic resistance. The user then stands on the floor plate 12 to provide additional stability to grip exercise assembly 10. The user may then lift the movable handle 32 from the rested position with their fingers until the stationary handle 22 can be grasped with the user's palm and thumb. Once grasped, the user can lift the weights 35 and/or stretch the elastic resistor 37 primarily with their fingers, wrist muscles, handle muscles, and forearm muscles while continuing grasp the stationary handle 22 thereby permitting a grip resistance workout.

Figure 6:
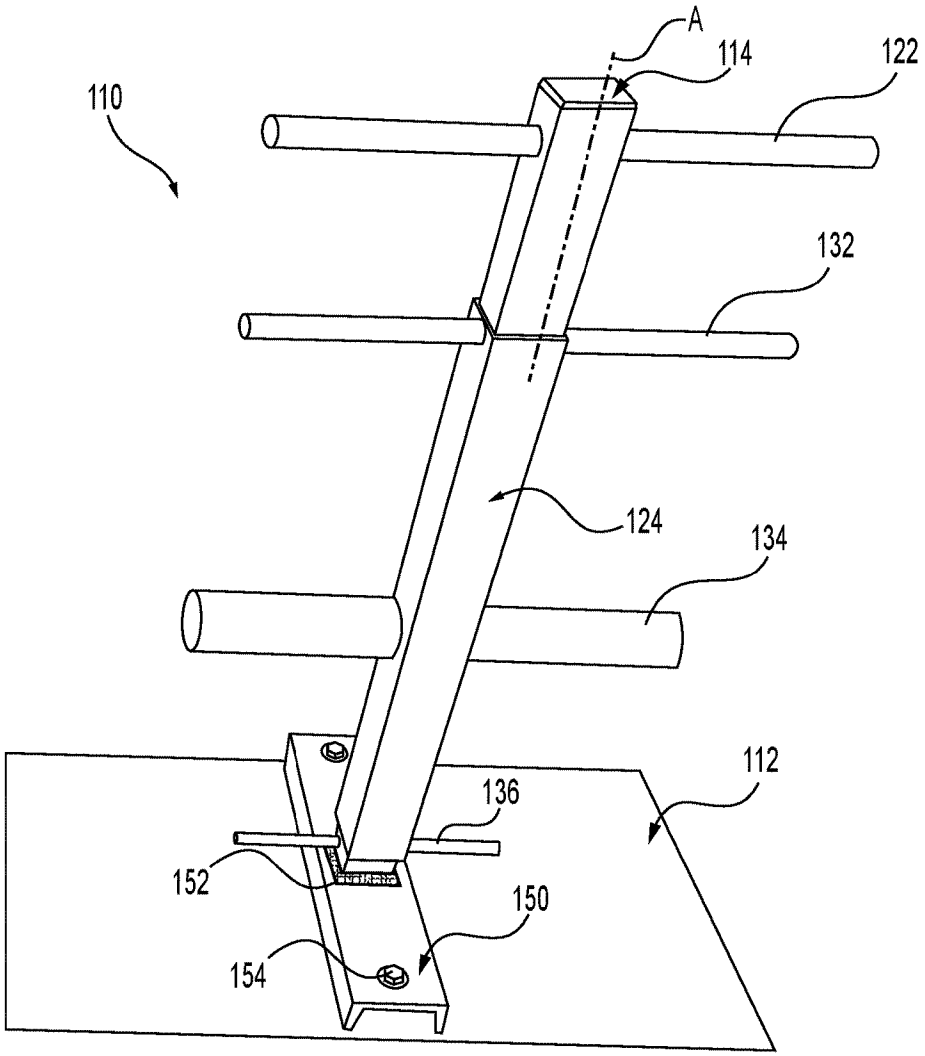
FIG. 6 shows a perspective view of an grip exercise assembly in accordance with a second embodiment.

FIG. 6 is a perspective view of a second grip exercise assembly 110 in accordance with a second embodiment. Unless otherwise indicated, the second grip exercise assembly 110 may share all the same features, materials, constructions, and methods of usage as the other embodiments described herein. The second grip exercise assembly 110 includes a second stationary body 114 that extends along an axis A and is selectively connected to a second floor plate 112. A second movable member 124 is sleeved around and movable relative to the second stationary body 114. A second stationary handle 122 extends horizontally outwardly from the second stationary body 114 and perpendicularly from the axis A. A second movable handle 132 extends horizontally outwardly from the second movable member 124 and perpendicularly from the axis A.

A first connection member 150 selectively connects the second stationary body 114 to the second floor plate 112. The second grip exercise assembly 110 may include a first weld interface 152 to provide a fixed connection between the first connection member 150 and one of the second stationary body 114 or the second floor plate 112. The second grip exercise assembly 110 may also include a first fastener interface 154 providing a selective connection to the other of the second stationary body 114 or the second floor plate 112. The first fastener interface 154 may include one or more fasteners, such as bolts or screws. Other types of fasteners may be used, such as a latching mechanism, etc. In some embodiments, and as shown in FIG. 6, the first weld interface 152 connects the first connection member 150 to the second stationary body 114 and the first fastener interface 154 connects the first connection member 150 to the second floor plate 112.

The first connection member 150 may include a rectangular-shaped face and a C-shaped cross-section. In some embodiments, and as shown in FIG. 6, the first fastener interface 154 may include a pair of bolts located at opposite ends of the rectangular-shaped face. In some embodiments, the first connection member 150 extends generally perpendicularly to the second stationary handle 122 and the second movable handle 132. The selective connection provided by the first connection member may permit disassembly of the second grip exercise assembly 110, which may be beneficial for and/or packaging.

Figure 7:
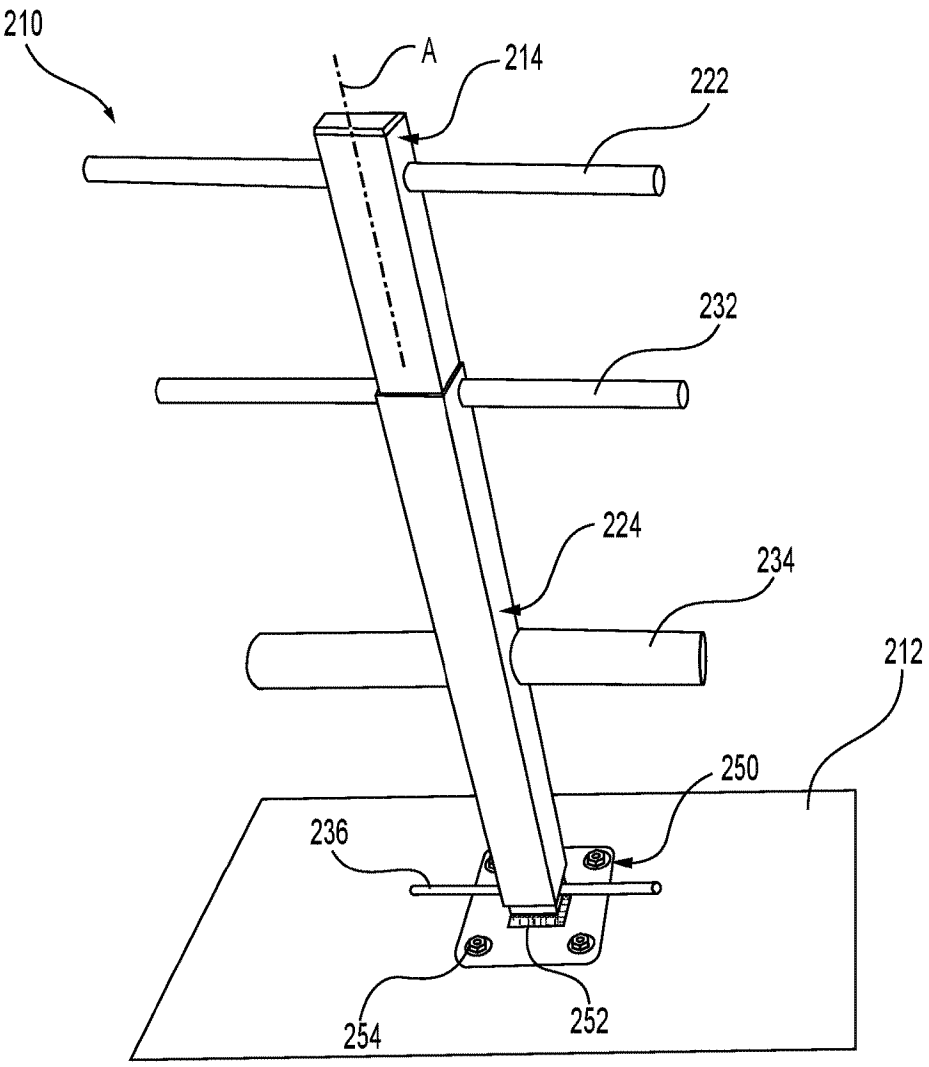
FIG. 7 shows a perspective view of a grip exercise assembly in accordance with a third embodiment.

FIG. 7 is a perspective view of a third grip exercise assembly 210 in accordance with a third embodiment. Unless otherwise indicated, the third grip exercise assembly 210 may share all the same features, materials, constructions, and methods of usage as the other embodiments described herein. The third grip exercise assembly 210 includes a third stationary body 214 that extends along an axis A and is selectively connected to a third floor plate 212. A third movable member 224 is sleeved around and movable relative to the third stationary body 214. A third movable member 224 is sleeved around and movable relative to the third stationary body 214. A third stationary handle 222 extends horizontally outwardly from the third stationary body 214 and perpendicularly from the axis A. A third movable handle 232 extends horizontally outwardly from the third movable member 224 and perpendicularly from the axis A.

A second connection member 250 selectively connects the third stationary body 214 to the third floor plate 212. The third grip exercise assembly 210 may include a second weld interface 252 to provide a fixed connection between the second connection member 250 and one of the third stationary body 214 or the third floor plate 212. The third grip exercise assembly 210 may also include a second fastener interface 254 providing a selective connection to the other of the third stationary body 214 or the third floor plate 212. The second fastener interface 254 may include one or more fasteners, such as bolts or screws. Other types of fasteners may be used, such as a latching mechanism, etc. In some embodiments, and as shown in FIG. 7, the second weld interface 252 connects the second connection member 250 to the third stationary body 214 and the second fastener interface 254 connects the second connection member 250 to the third floor plate 212.

The second connection member 250 may include a square-shaped face and a flat cross-section. The second fastener interface 254 may include a bolt located at each corner of the square-shaped face of the second connection member 250. In some embodiments, the square-shaped face of the second connection member 250 extends generally perpendicularly to the third stationary handle 222 and the third movable handle 232. In some embodiments, the second connection member 250 extends outwardly from the axis A a distance shorter than a third rod 234 and/or shorter than a third resistance holding projection 236. The selective connection provided by the second connection member 250 may permit disassembly of the third grip exercise assembly 210, which may be beneficial for and/or packaging.

Many modifications and variations of the present invention are possible in light of the above teachings and may be practiced otherwise than as specifically described. In addition, the reference numerals are merely for convenience and are not to be read in any way as limiting. Note that not all of the activities described above in the general description or the examples are required, that a portion of a specific activity may not be required, and that one or more further activities may be performed in addition to those described. Still further, the orders in which activities are listed are not necessarily the order in which they are performed. The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Furthermore, certain features are, for clarity, described herein in the context of separate embodiments, may also be provided in combination in a single embodiment. Conversely, various features that are, for brevity, described in the context of a single embodiment, may also be provided separately or in any sub combination.

What is claimed:

1. A grip exercise assembly comprising:

a stationary body extending along an axis and including a stationary handle;

a movable member having a tubular wall extending about the axis and defining an interior cavity, the movable member sleeved around the stationary body and slidable therealong, the movable member including a movable handle and a rod configured to receive at least one of a plate weight or an elastic resistor, wherein the at least one of the plate weight or the elastic resistor applies a bias force causing the movable member to slide along the stationary body away from the stationary handle, and wherein the rod includes two rod portions extending in opposite directions perpendicular to the axis.

2. The grip exercise assembly of claim 1, further including a floor plate connected to the stationary body and extending perpendicular to the axis.

3. The grip exercise assembly of claim 2, wherein the floor plate defines a non-smooth upper surface.

4. The grip exercise assembly of claim 2, wherein the stationary body is removable from the floor plate and selectively connected thereto with a connection member.

5. The grip exercise assembly of claim 1, wherein the stationary body defines a uniform section including a uniform outer cross-section extending along the axis.

6. The grip exercise assembly of claim 1, wherein the movable member includes an upper surface oriented towards the stationary handle and the upper surface defines notches for receiving the stationary handle.

7. The grip exercise assembly of claim 1, wherein the stationary handle includes two stationary handle portions extending in opposite directions perpendicular to the axis; and wherein the movable handle includes two movable handle portions extending in opposite directions perpendicular to the axis.

8. The grip exercise assembly of claim 1, wherein the stationary body includes a first resistance holding projection located under the rod for attachment of a first elastic resistor between the first resistance holding projection and the rod; and wherein the stationary body includes a second resistance holding projection located under the rod for attachment of a second elastic resistor between the second resistance holding projection and the rod.

9. A grip exercise assembly comprising:

a stationary body extending along an axis;

a movable member having a tubular wall sleeved around the stationary body and slidable therealong, and a movable handle projecting from the tubular wall; and a floor plate connected to the stationary body and extending perpendicular to the axis, wherein the stationary body includes a stationary handle having two stationary handle portions extending in opposite directions perpendicular to the axis; and wherein the movable handle includes two movable handle portions extending in opposite directions perpendicular to the axis.

10. The grip exercise assembly of claim 9, wherein the movable member further includes a rod configured to receive at least one of a plate weight or an elastic resistor.

11. The grip exercise assembly of claim 10, wherein the stationary body includes a resistance holding projection located under the movable member for attachment of the elastic resistor between the resistance holding projection and the rod.

12. The grip exercise assembly of claim 9, wherein the stationary body defines a uniform section including a uniform outer cross-section extending along the axis.

13. The grip exercise assembly of claim 12, wherein the uniform outer cross-section is rectilinear with curved corners.

14. The grip exercise assembly of claim 9, wherein the floor plate defines a non-smooth upper surface.

15. The grip exercise assembly of claim 9, wherein the movable member includes an upper surface oriented towards the stationary handle and the upper surface defines notches for receiving the stationary handle.

16. A grip exercise assembly comprising:

a stationary body extending along an axis and including a stationary handle;

a movable member having a tubular wall extending about the axis and defining an interior cavity, the movable member sleeved around the stationary body and slidable therealong; and the movable member including a movable handle and a rod configured to receive at least one of a plate weight or an elastic resistor, wherein the stationary body includes a resistance holding projection located under the movable member for attachment of the elastic resistor between the resistance holding projection and the rod.

17. The grip exercise assembly of claim 16, wherein the movable member includes a lower surface oriented towards the resistance holding projection and the lower surface defines notches for receiving the resistance holding projection.

* * * * *